US005946966A

United States Patent [19]

Madaffer

[11] Patent Number: 5,946,966

[45] Date of Patent: Sep. 7, 1999

[54] UPSET FORGING MACHINE ASSEMBLY HAVING A QUICK CHANGE HEADER

[75] Inventor: Tony Madaffer, White Lake, Mich.

[73] Assignee: Tool Dex, Inc., Warren, Mich.

[21] Appl. No.: 08/936,368

[22] Filed: Sep. 24, 1997

[51] Int. Cl.[6] ..... B21D 37/00

[52] U.S. Cl. ..... 72/481.8; 72/357; 72/358; 470/139; 470/141

[58] Field of Search ..... 72/481.1, 481.2, 72/481.3, 481.6, 481.7, 481.8, 462, 357, 358, 359, 354.2; 470/63, 89, 91, 137, 138, 139, 141, 150, 205

[56] References Cited

U.S. PATENT DOCUMENTS

| | | | |
|---|---|---|---|
| Re. 30,934 | 5/1982 | Hehl | 91/519 |
| 3,559,446 | 2/1971 | Dom et al. | 470/139 |
| 3,638,473 | 2/1972 | McElroy | 72/462 |
| 3,818,801 | 6/1974 | Kime | 91/411 |
| 4,100,638 | 7/1978 | Fischer | 470/141 |
| 4,170,051 | 10/1979 | O'Keffe et al. | 470/138 |
| 4,173,883 | 11/1979 | Boik | 72/354 |
| 4,505,144 | 3/1985 | Sakuma et al. | 72/345 |
| 4,791,803 | 12/1988 | Broquet et al. | 72/481.2 |
| 4,831,861 | 5/1989 | Hofmann et al. | 72/354 |
| 5,007,282 | 4/1991 | Bakermans | 72/481.8 |

*Primary Examiner*—Joseph J. Hail, III
*Assistant Examiner*—Ed Tolan
*Attorney, Agent, or Firm*—Howard & Howard

[57] ABSTRACT

A upset forging machine assembly (20) including a pair of gripper dies (22, 24) for gripping forging stock in a closed position and movable to an open position for receiving stock and removing a forged part. A gripper drive mechanism (34) moves the gripper dies (22, 24) between the open and closed positions. A header (84) is removably clamped to a header support member (36) by multiple pairs of studs (72) extending from the header support member (36) with each stud (72) having a head (78) disposed in an associated channel (90) in the header (84). An actuation mechanism (92, 94) moves the studs (72) between a clamped position and a release position. A tool punch (142) is supported by the header (84) for upsetting the forging stock. Having the header (84) clamped to the header support member (36), a header drive mechanism (46) moves the header support member (36) to a forging position is when the gripper dies (22, 24) are in the closed position. In turn, the header drive mechanism (46) moves the header support member (36) to a retracted position. At the same time, the gripper drive mechanism (34) moves the gripper dies (22, 24) to the open position allowing the forged part to be removed.

24 Claims, 9 Drawing Sheets

UPSET FORGING MACHINE ASSEMBLY HAVING A QUICK CHANGE HEADER

BACKGROUND OF THE INVENTION

1. Field of Invention

The subject invention relates to an upset forging machine assembly. More specifically, the subject invention relates to an upset forging machine assembly having a header removably mounted to a header support member.

2. Description of Prior Art

Upset forging machine assemblies shape forging stock by hammering the stock with a tool punch. Typically, the assembly will employ a series of progressive tool punches to achieve the desired final shape. The tool punches are required to be replaced when they wear out or when a different shaped part is desired.

It is a constant objective to minimize the time and effort to replace the tool punches. The conventional approach to realizing this objective is to support the tool punches on a common header removably mounted to a header support member. This approach allows the tool punches to be removed and replaced all at once by removing and replacing the header. However, typical removable headers are mounted to the header support member by multiple bolts requiring manual removal and replacement resulting in a relatively long change-over time period. In addition, the header support member is generally set in a trench which makes the bolts difficult to access which adds to the time and effort required to remove and replace the tool punches.

Thus, there is the need for an upset forging machine assembly which provides a simple and efficient means of removing and replacing tool punches.

SUMMARY OF THE INVENTION AND ADVANTAGES

An upset forging machine assembly comprising a pair of gripper dies supported by a support frame for gripping forging stock in a closed position and movable to an open position for receiving stock and removing a forged part. A gripper drive mechanism supported by the support frame for moving the gripper dies between the open and closed positions. A header support member, presenting a front face with a stud having a head extending from the front face, movably supported by the support frame for movement between a retracted position spaced from the gripper dies and a forging position adjacent to the gripper dies when the gripper dies are in the closed position. A header having a clamping face with a channel and a slot opening into the channel for removably receiving the stud for clamping the clamping face against the front face of the header support member. A tool punch supported on the header for upsetting the forging stock in the forging position. A header drive mechanism supported by the support frame for moving the header support member between the forging and retracted positions.

Accordingly, the subject invention provides an upset forging machine assembly offering a simple and efficient means of removing and replacing tool punches.

DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Referring to the Figures, wherein like numerals indicate like or corresponding parts throughout the several views, an upset forging machine assembly is generally shown at 20.

Figure 1:
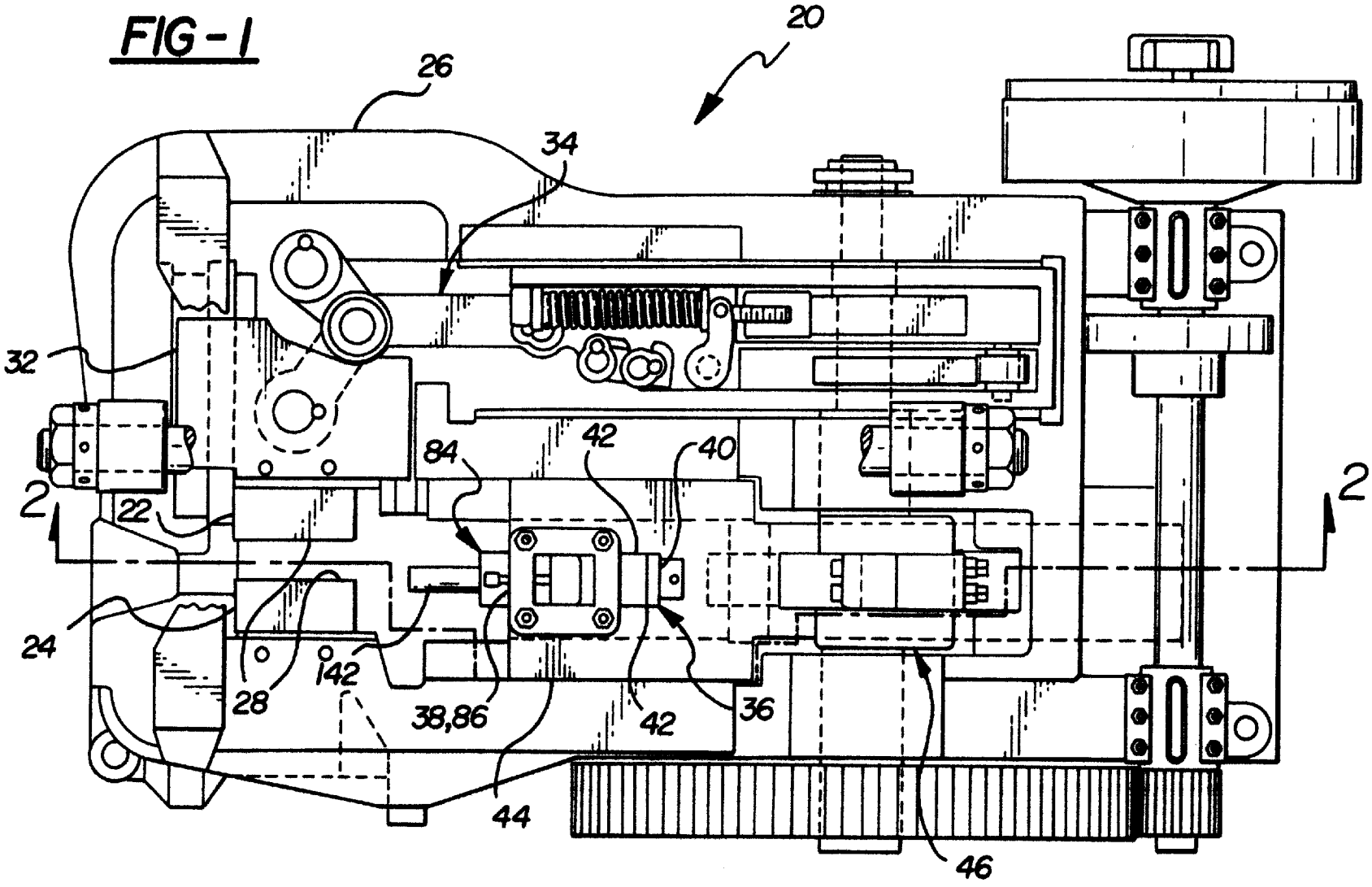
FIG. 1 is a top view of the upset forging machine assembly.
Figure 2:
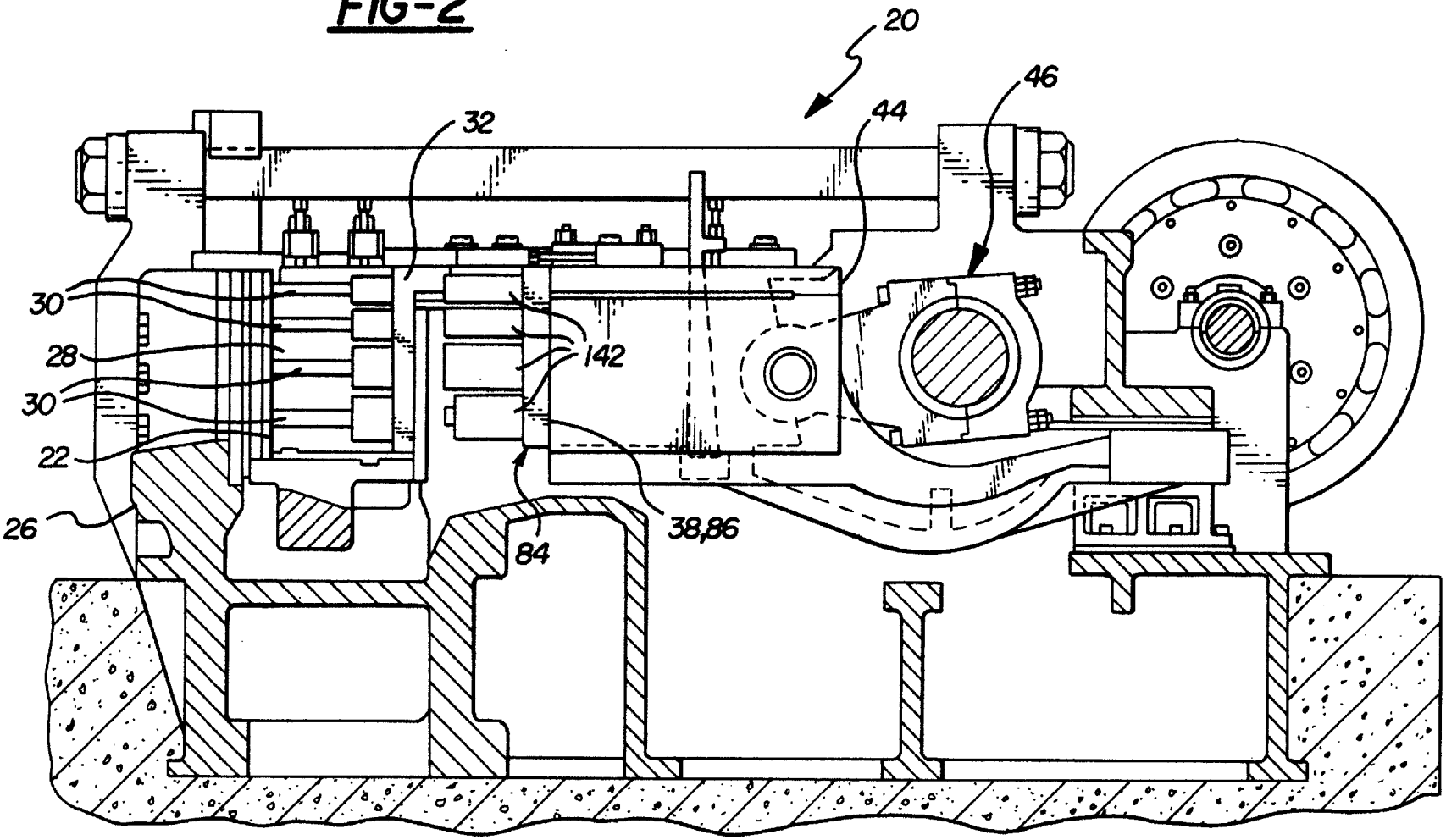
FIG. 2 is cross sectional view taken along the line 2—2 of FIG. 1.
Figure 3:
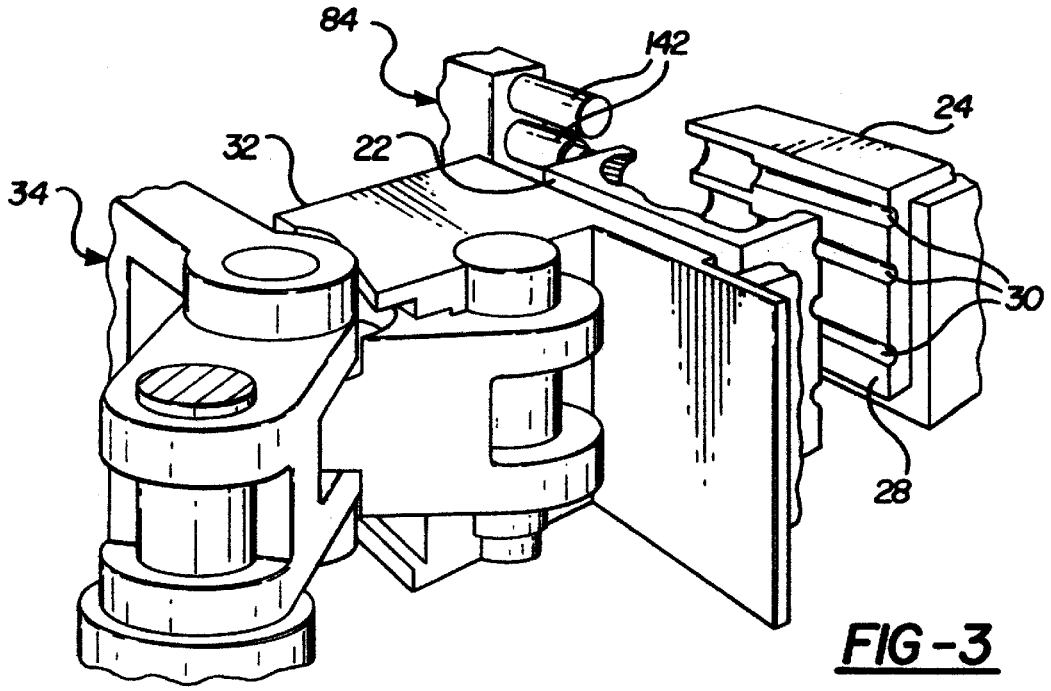
FIG. 3 is perspective view of the gripper dies shown in the open position.

As best shown in FIG. 3, the assembly 20 comprises a pair of gripper dies 22, 24 supported by a support frame 26 for gripping forging stock (not shown) in a closed position and movable to an open position for receiving stock and removing a forged part. Specifically, the gripper dies 22, 24 consist of a movable gripper die 22 and a stationary gripper die 24, each die 22, 24 having a matching work face 28 directly opposite each other with at least one horizontal groove 30 for gripping the forging stock. The movable gripper die 22 is mounted to a gripper slide 32 slidably supported by the support frame 26. A gripper drive mechanism, generally indicated at 34, is supported by the support frame 26 and fastened to the gripper slide 32 for moving the movable gripper die 22 between the open and closed positions. The gripper drive mechanism 34 is of a type well known in the art. The open position is defined by the work faces 28 being spaced apart. The closed position is defined by the work faces 28 being in contact with one another.

A header support member, generally indicated at 36, presenting a front face 38, a rear face 40 opposite the front face 38, and sides 42 extending from the front face 38 to the rear face 40, is mounted to a header slide 44 slidably supported by the support frame 26. A header drive mechanism, generally indicated at 46, is supported by the support frame 26 and fastened to the header slide 44 for moving the header support member 36 between a retracted position spaced from the gripper dies 22, 24 and a forging position adjacent to the gripper dies 22, 24 when the gripper dies 22, 24 are in the closed position. The header drive mechanism 46 is of a type well known in the art.

Figure 8:
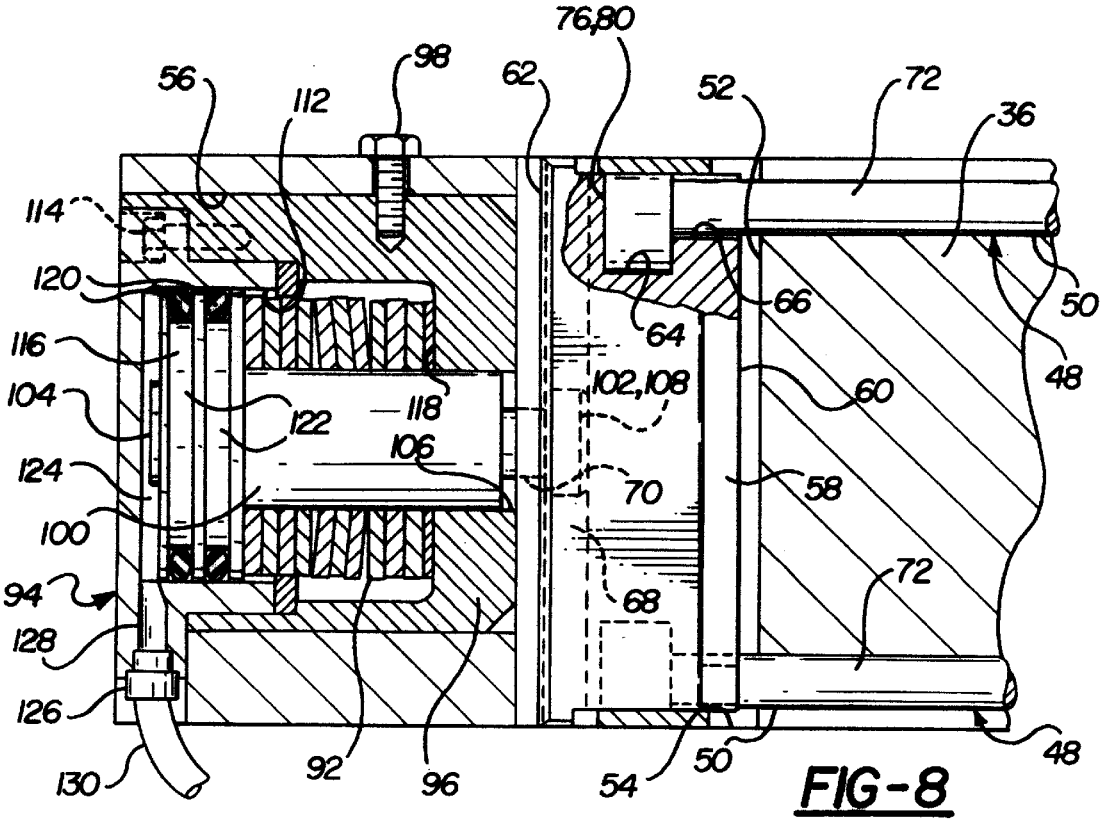
FIG. 8 is a cross sectional view taken along the line 8—8 of FIG. 4.
Figure 4:
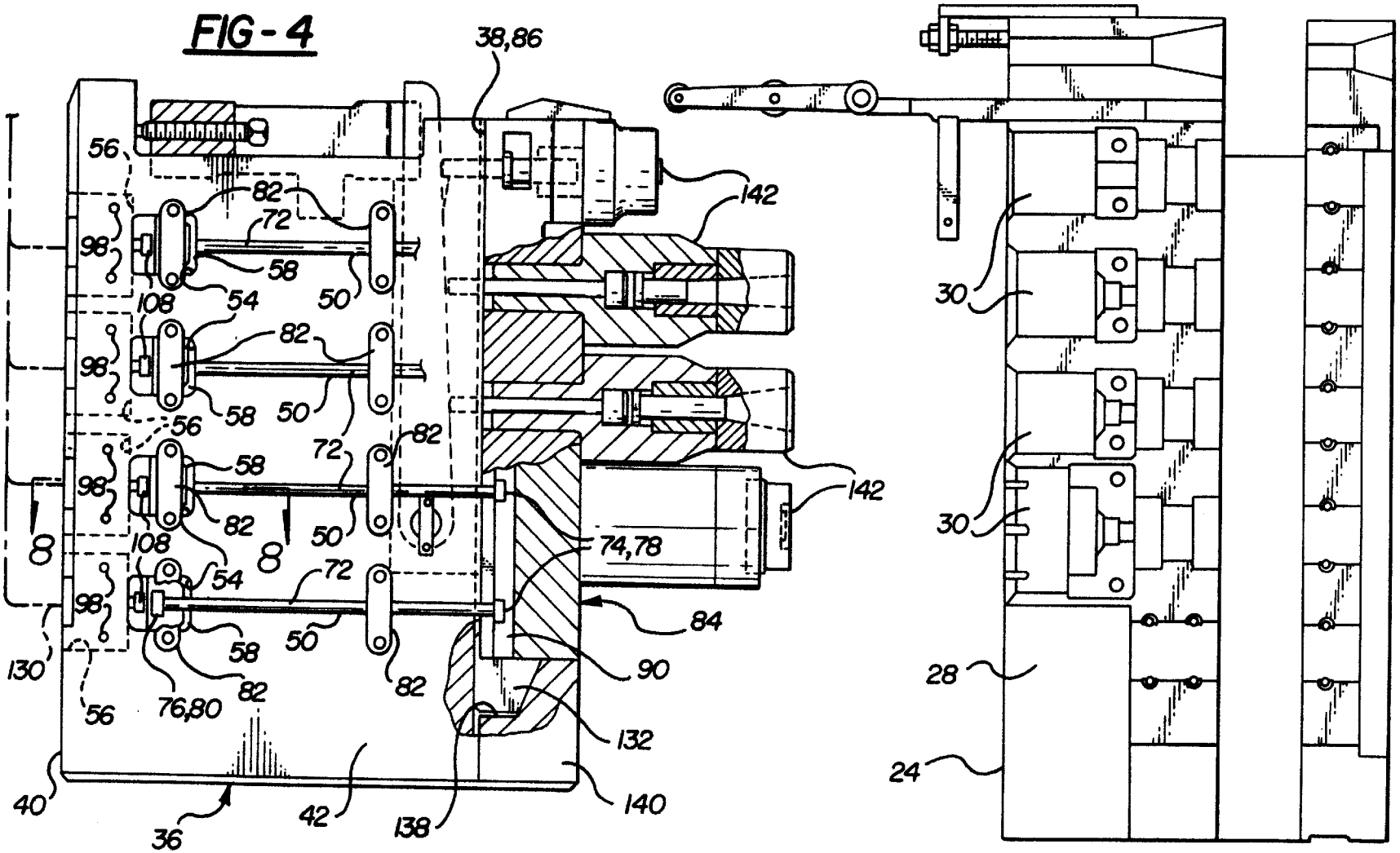
FIG. 4 is a side view of the header support member, the header and the movable gripper die shown in the retracted position, partially broken away and cross sectioned to show the studs in the clamped position.
Figure 5:
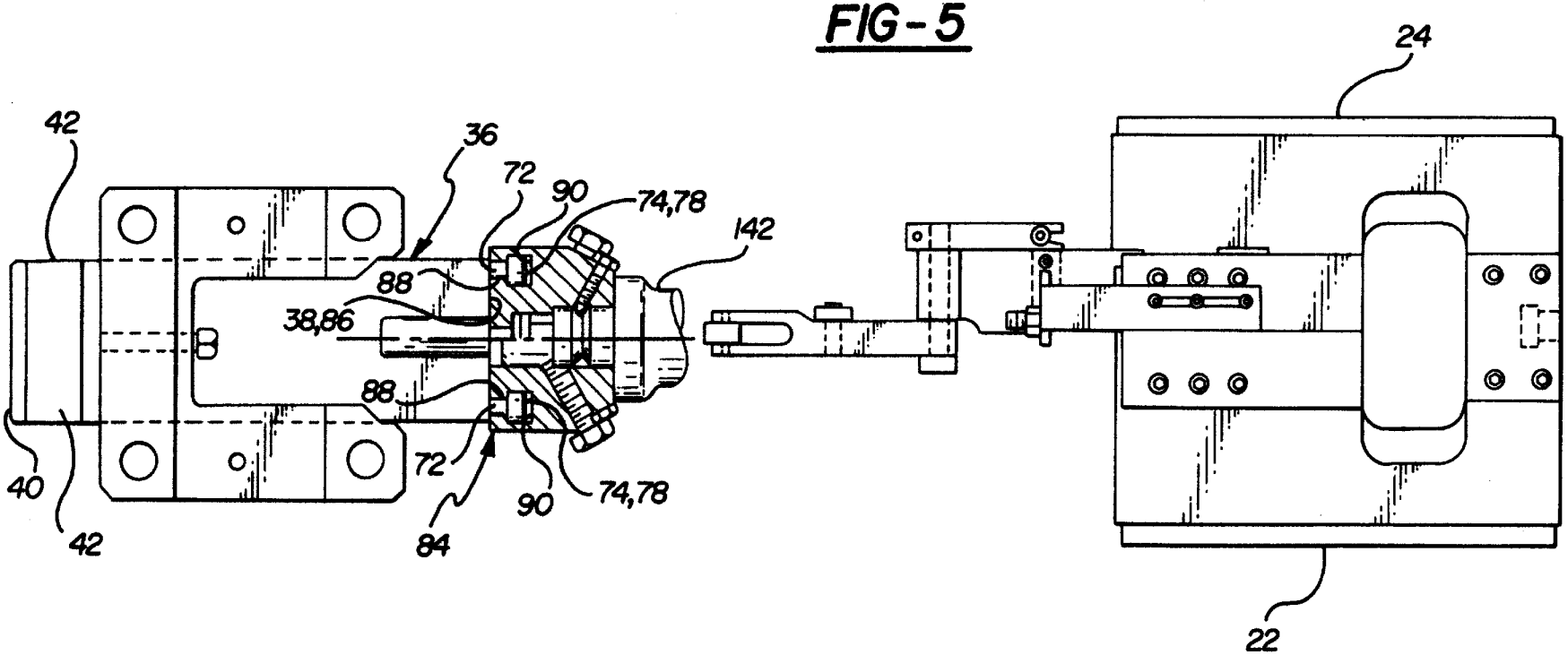
FIG. 5 is a top view of the header support member, the header and the gripper dies shown in the retracted and closed positions, partially in cross section.
Figure 6:
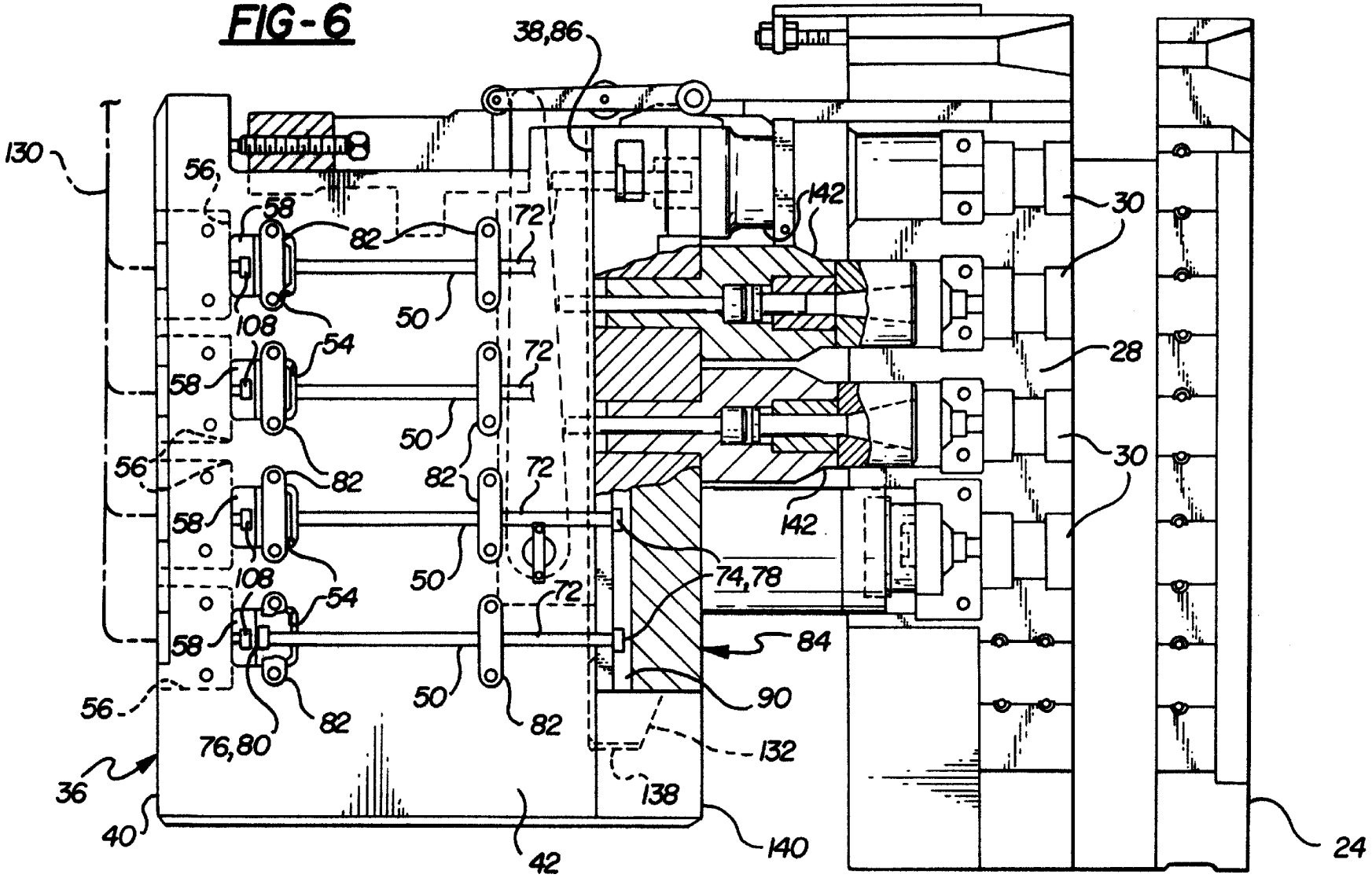
FIG. 6 is a side view of the header support member, the header and the movable gripper die shown in the forging position, partially broken away and cross sectioned to show the studs in the clamped position.
Figure 10:
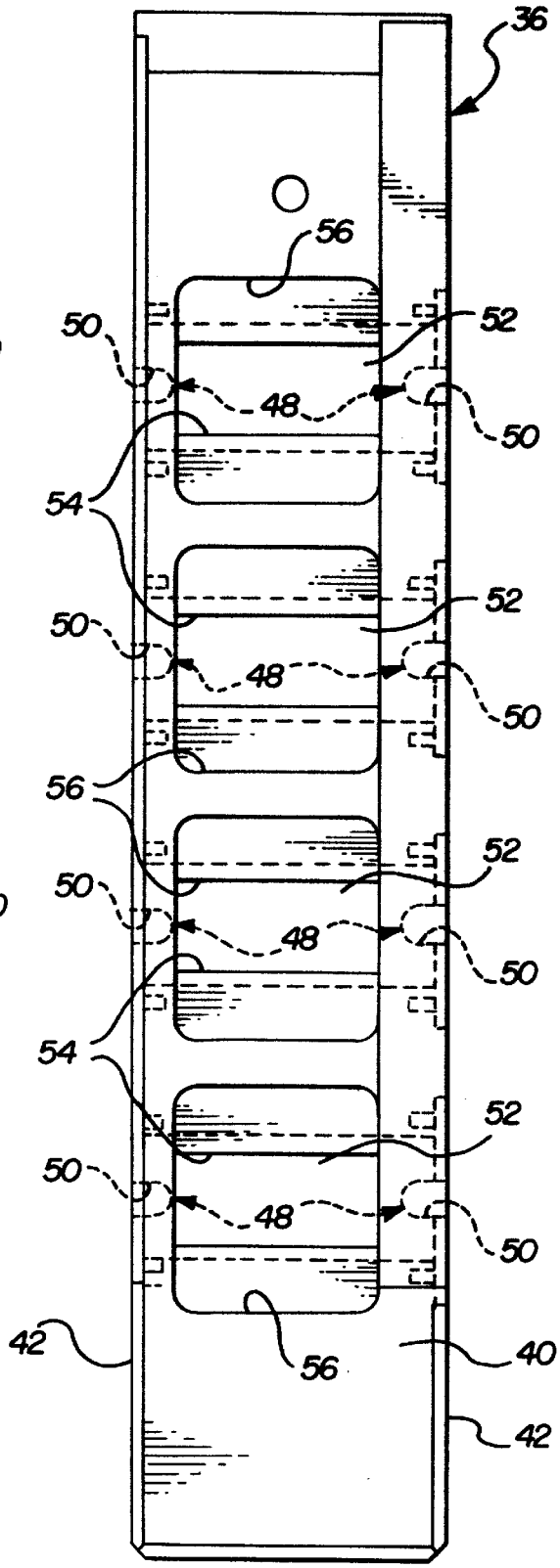
FIG. 10 is a rear view of the header support member having the studs and the hydraulic piston and cylinder assembly removed.
Figure 13:
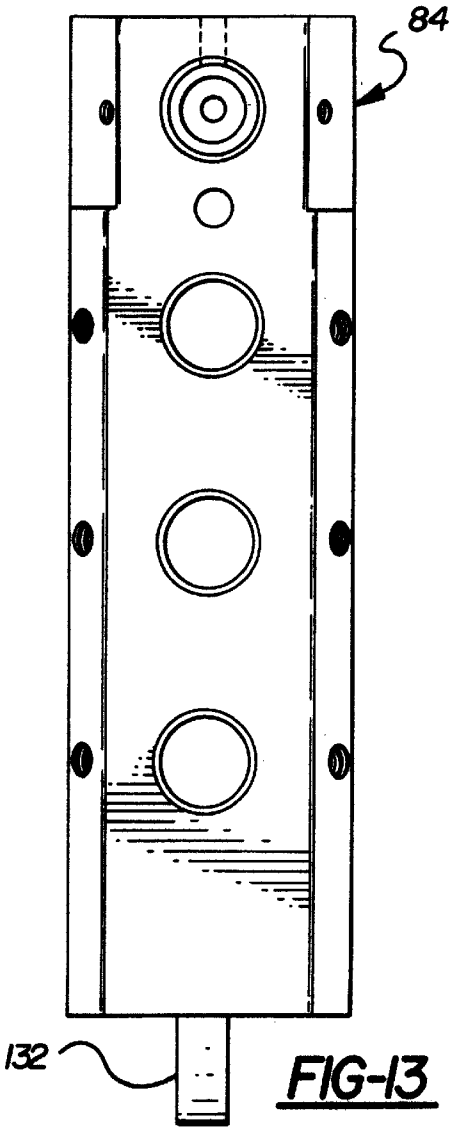
FIG. 13 is a front view of the header having the tool punches removed.

The header support member 36 further includes multiple pairs of horizontal grooves, generally indicated at 48, having a groove 50 in each side of the header support member 36 directly opposite its pair (FIG. 10). Each groove 50 making up a given pair of grooves 48 extends from the front face 38 of header support member 36 to a rearward facing surface 52 of a cavity 54. The cavity 54 is located between the front 38 and rear faces 40 of the header support member 36 and passes through the width of the header support member 36. The header support member 36 further includes a socket 56 in the rear face 40 of the header support member 36 joining the cavity 54. A drive block 58, presenting a front face 60 and a rear face 62 opposite the front face 60, is slidably disposed in the cavity 54 with the front face 60 of the drive block 58 being adjacent to rearward facing surface 52 of the cavity 54 (FIG. 8). The drive block 58 includes a pair of pockets 64 and a slot opening 66 extending from each of the pockets 64 to the front face 60 of the drive block 58 with the slot openings 66 aligning with the associated pair of grooves 48 joining the cavity 54. The drive block 58 further includes a channel 68 extending through the width of the drive block 58 and a slot opening 70 extending from channel 68 to the rear face 62 of the drive block 58. A stud 72 having first and second ends 74 and 76, respectively, is disposed in each of the grooves 50 in the header support member 36. A first head 78 at the first end 74 of the stud 72 extends outwardly beyond the front face 38 of the header support member 36. The second end 76 of the stud 72 extends into the cavity 54 with a second head 80 at the second end 76 of the stud 72 being disposed in the associated pocket 64 of the drive block 58. Each stud 72 is retained in the associated groove 50 by a pair of recessed clamps 82 bolted to the side 42 of the header support member 36.

Figure 11:
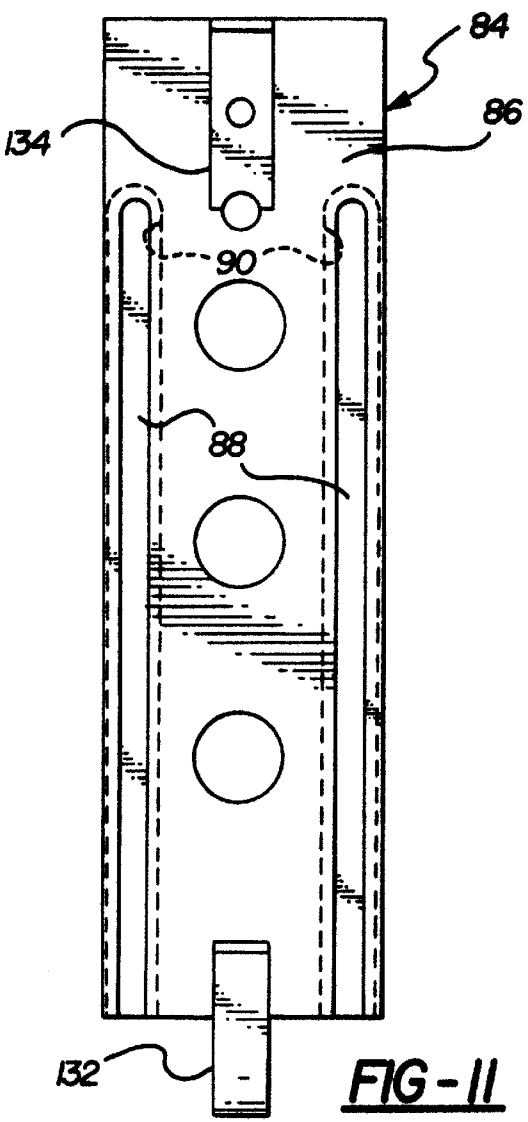
FIG. 11 is a rear view of the header having the tool punches removed.

A header, generally indicated at 84, having a clamping face 86 is supported on the front face 38 of the header support member 36. Specifically, the header 84 includes a pair of slot openings 88 in the clamping face 86 extending vertically from the bottom of the header 84 to some distance from the top of the header 84 (FIG. 11). The slot openings 88 align with one or the other studs 72 disposed in a given pair of grooves 48. The slot openings 88 each join one of a pair of channels 90 forming a pair of T-slots in the header. The first heads 78 of the studs 72 are disposed in the associated channels 90 in the header 84 for supporting the header 84 on the header support member 36.

As best shown in FIG. 8, the header support member 36 further includes an actuation mechanism disposed in each of the sockets 56 comprising a biasing means consisting of at least one Belleville washer 92 for placing the studs 72 in a clamping position whereby the studs 72 are placed in tension so as to clamp the clamping face 86 of the header 84 against the front face 38 of the header support member 36. The actuation mechanism further includes an actuator, generally indicated at 94, for moving the associated pair of studs 72 against the Belleville washers 92 to a release position with the clamping face 86 spaced from the front face 38 of the header support member 36. The actuator 94 comprises a housing 96 disposed in the socket 56. The housing 96 is retained in the socket 56 by a pair of bolts 98. A hydraulically actuated piston 100, having first and second ends 102 and 104, respectively, is disposed in the housing 96. The piston 100 extends through an opening 106 in the housing 96 into the cavity 54 with a head 108 at the first end 102 being disposed in the channel 68 of the drive block 58. An end plate 110 having an inner wall defining a cylinder 112 is disposed in the housing 96 adjacent to the second end 104 of the piston 100. The end plate 110 is fastened to the housing 94 by multiple bolts 114. The cylinder 112 surrounds a portion of the piston 100 adjacent to the second end 104 of the piston 100. The Belleville washers 92 are retained about the piston 100 between a stepped portion 116 of the piston 100 located between the first 102 and second 104 ends of the piston 100 and a rearward facing surface 118 of the housing 96 located adjacent to the rear face 62 of the drive block 58. An O-ring 120 is disposed in each of a pair of grooves 122 in the stepped portion 116 of the piston 100 for providing a fluid seal in the cylinder 112. A fluid chamber 124 is formed between the end plate 110 and the second end 104 of the piston 100. A fitting 126 having a pressure valve 128 joining the fluid chamber 124 is secured to the end plate 110. A hydraulic line 130 interconnects the fitting 126 and a hydraulic pump (not shown).

Figure 7:
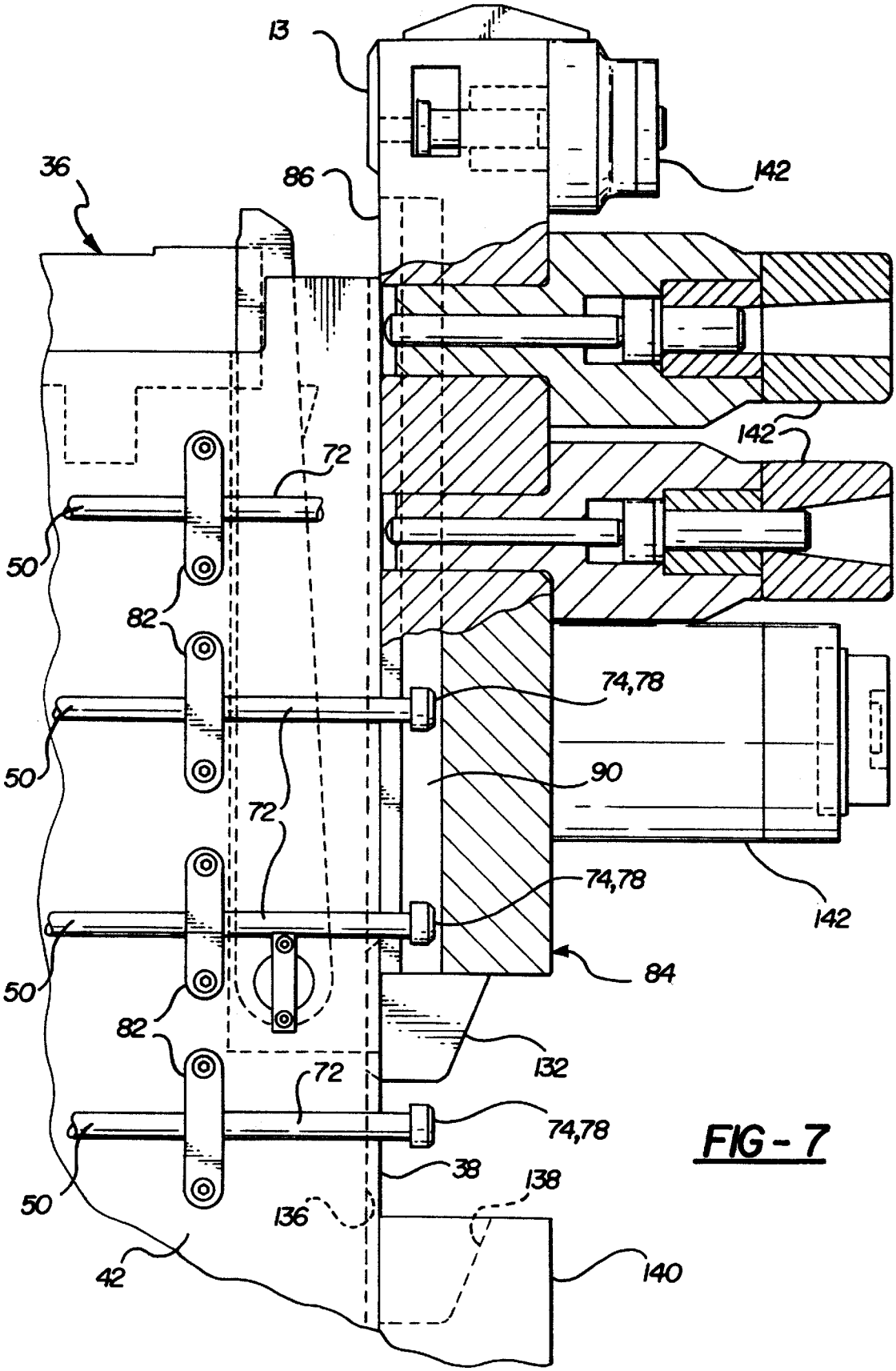
FIG. 7 is an enlarged fragmentary view of the header support member and the header shown in a partially raised position and partially in cross section to show the studs in the release position.
Figure 9:
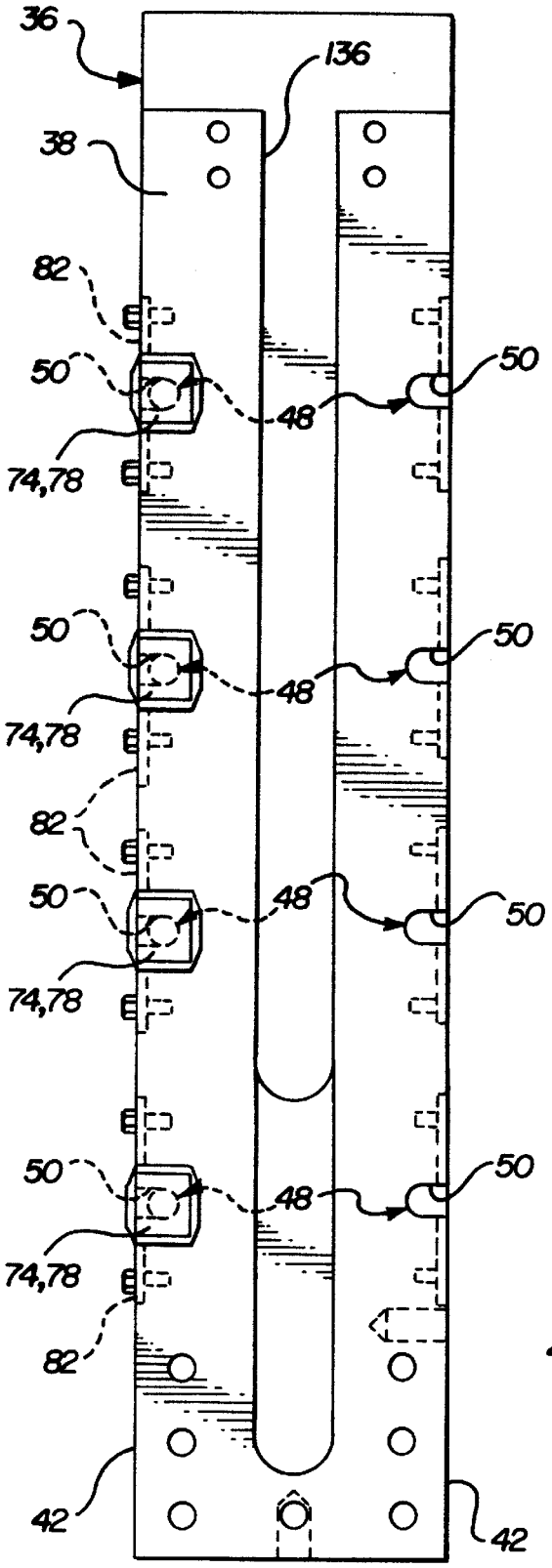
FIG. 9 is a front view of the header support member having the studs removed from one side.
Figure 12:
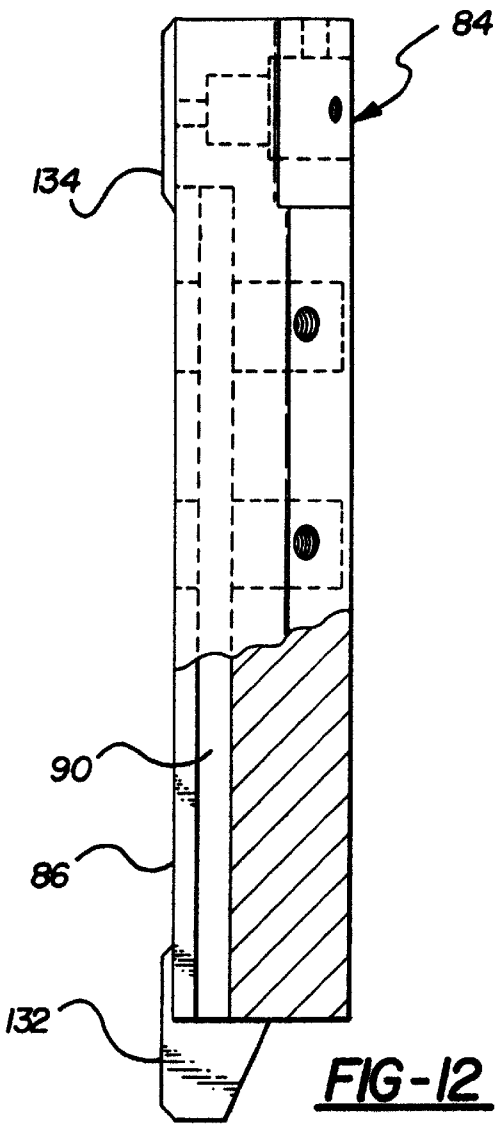
FIG. 12 is a side view of the header having the tool punches removed.

As best shown in FIGS. 9 and 12, the assembly 20 further includes co-acting guides in the clamping face 86 of the header 84 and in the front face 38 of the header support member 36 for aligning the header 84 relative to the header support member 36. Specifically, the header 84 includes a first locator key 132 located adjacent to the bottom of the header 84 and midway between the sides of the clamping face 86 which extends outwardly from and below the clamping face 86. The header 84 further includes a second locator key 134 located adjacent to the top of the header 84 and midway between the sides of the clamping face 86 which extends outwardly from the clamping face 86. The locator keys 132, 134 mate with a slot or keyway 136 in the front face 38 of the header support member 36 which extends vertically from the top of the header support member 36 to some distance from the bottom of the header support member 36 and is located midway between the sides of the header support member 36. In addition, the portion of the first locator key 132 which extends below the clamping face 86 mates with a keyway 138 in the top of a support base 140 bolted to the front face 38 of the header support member 36 (FIG. 7).

At least one tool punch 142 is bolted the header 84 for upsetting the forging stock in the forging position. The tool punches 142 are in the plane of the work faces 28 of the gripper dies 22, 24 and align with the center of the grooves 30 of the gripper dies 22, 24 when the gripper dies 22, 24 arc in the closed position.

In operation, the header 84 is mounted to the header support member 36 by manually or automatically pumping fluid into the fluid chamber 124. As the pressure in the fluid chamber 124 increases, the force applied to the piston 100 by the Belleville washers 92 is overcome and the piston 100 is forced to move longitudnally toward the front face 38 of the header support member 36. In turn, the piston 100 slidably displaces the drive block 58 which forces the first heads 78 of the associated pair of studs 72 to more longitudnally away from the front face 38 of the header support member 36. The first heads 78 of the studs 72 reach the release position when the front face 60 of the drive block 58 engages the rearward facing surface 52 of the cavity 54. With the header 84 supported above the header support member 36 by a hoist or the like, the first locator key 132 is then inserted into the keyway 136 in the front face 38 of the header support member 36 aligning the slot openings 88 in the header 84 with the studs 72 extending from the front face 38 of the header support member 36. The header 84 is then lower whereby the channels 90 slide along the first heads 78 of the associated studs 72. As the header 84 continues to be lowered, the first locator key 132 enters into the keyway 138 in the support base 140 and the second locator key 134 enters into the keyway 136 in the front face 38 of the header support member 36. Once the bottom of the header 84 engages the top of the support base 140, the tool punches 142 and horizontal grooves 30 in the gripper dies 22, 24 are properly aligned. The clamping face 86 of the header 84 is then clamped against the front face 38 of the header support member 36 by pumping fluid out of the fluid chamber 124. As the pressure in the fluid chamber 124 decreases, the Belleville washers 92 force the piston 100 to move longitudnally away from the front face 38 of the header support member 36. In turn, the piston 100 displaces the drive block 58 which forces the first heads 78 of the studs 72 to move longitudnally toward the front face 38 of the header support member 36. Having sufficiently released the pressure in the fluid chamber 124, the studs 72 are placed in tension clamping the clamping face 86 of the header 84 against the front face 38 of the header support member 36.

The header 84 is removed by pumping fluid into the fluid chamber 124 thereby moving the studs 72 to the release position. The header 84 is then raised whereby the channels 90 in the header 84 slide along the first heads 78 of the associated studs 72. The header 84 continues to be raised until the channels 90 in the header 84 have cleared each of the first heads 78 of the associated studs 72. Having reached this point, the first locator key 132 is removed from the keyway 136 in the header support member 36 whereby the header 84 is completely removed from the header support member 36. In addition, the header 84 can be clamped to the header support member 36 in a partially raised position. Specifically, having place the studs 72 in the released position, the header 84 is then raised to a point where the first heads 78 of at least one pair of studs 72 remain disposed in the channels 90 in the header 84. The studs 72 are then placed in the clamping position whereby the header 84 is supported on the header support member 36 in a partially raised position.

With the header 84 fully seated on the support base 140 and the studs 72 placed in the clamped position, the forging stock is placed in a horizontal groove 30 in the stationary gripper die 24 representing the first stage in the forging process. The forging stock is held in the groove 30 by the friction force between the forging stock and the groove 30. The gripper drive mechanism 34 then slidably displaces the movable gripper die 22 to the closed position whereby the forging stock is gripped by the matching grooves 30 of the gripper dies 22, 24. The header drive mechanism 46 then slidably displaces the header support member 36 to the forging position whereby the tool punch 142 associated with the grooves 30 gripping the forging stock upsets the forging stock. The header drive mechanism 46 then moves the header support member 36 to the retracted position. At the same time, the gripper drive mechanism 34 moves the movable gripper die 22 to the open position. The forged part is then removed and advanced to the horizontal groove 30 in the stationary gripper die 24 representing the next forging stage. The cycle is then repeated until the last stage in the forging process is completed. Having completed the forging process, the completely forged part is then removed and replaced by a new forging stock.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An upset forging machine assembly (20) comprising:

a support frame (26);

a pair of gripper dies (22, 24) supported by said support frame (26) for gripping forging stock in a closed position and movable to an open position for receiving stock and removing a forged part;

a gripper drive mechanism (34) supported by said support frame (26) for moving said gripper dies (22, 24) between said open and closed positions;

a header support member (36) presenting a front face (38) and movably supported by said support frame (26) for movement between a retracted position spaced from said gripper dies (22, 24) and a forging position adjacent to said gripper dies (22, 24) when said gripper dies (22, 24) are in said closed position;

a header drive mechanism (46) supported by said support frame (26) for moving said header support member (36) between said forging and retracted positions;

a header (84) having a clamping face (86) and supported on said front face (38) of said header support member (36);

a tool punch (142) supported on said header (84) for upsetting the forging stock in said forging position;

said header (84) including a channel (90) and a slot opening (88) joining said channel (90) and including a stud (72) extending from a front face (38) of said header support member (36) through said slot opening (88) having a head (78) disposed in said channel (90) for removably securing said header (84) to said header support member (36);

an actuation mechanism (92, 94) for placing said stud (72) in tension to clamp said clamping face (86) of said header (84) against said front face (38) of said header support member (36); and said actuation mechanism (92, 94) including a biasing means (92) for placing said stud (72) in tension and a hydraulic actuator (94) for moving said stud (72) against said biasing means (92) to a release position with said clamping face (86) spaced from said front face (38) to remove said header (84) by sliding said channel (90) along said head (78) of said stud (72).

2. An assembly (20) as set forth in claim 1 wherein said biasing means (92) comprises at least one Belleville washer (92).

3. An assembly (20) as set forth in claim 2 wherein said actuator (94) comprises a hydraulic piston and cylinder assembly (94) for moving said stud (72) longitudinally.

4. An assembly (20) as set forth in claim 3 wherein said header support member (36) presents a rear face (40) opposite said front face (38) and sides (42) extending from said front face (38) to said rear face (40).

5. An assembly (20) as set forth in claim 4 including a socket (56) disposed in said rear face (40), said Belleville washer (92) disposed in said socket (56), said hydraulic piston and cylinder assembly (94) disposed in said socket (56).

6. An assembly (20) as set forth in claim 5 including a cavity (54) adjoining said socket (56) and a drive block (58)

slidably disposed in said cavity (54) interconnecting said piston and cylinder assembly (94) and said stud (72).

7. An assembly (20) as set forth in claim 6 including a pair of said channels (90) and a pair of said slot openings (88).

8. An assembly (20) as set forth in claim 6 including a plurality of said studs (72), a plurality of said sockets (56), a plurality of said cavities (54), and a plurality of grooves (50) in said sides (42) of said header support member (36) extending from said front face (38) to said cavities (54), each of said studs (72) being disposed in one of said grooves (50).

9. An assembly (20) as set forth in claim 8 including a clamp (80) associated with each groove (50) for retaining the associated stud (72) therein.

10. An assembly (20) as set forth in claim 1 including co-acting guides (132, 134, 136, 138) in said clamping face (86) of said header (84) and in said front face (38) of said header support member (36) for aligning said header (84) relative to said header support member (36).

11. An upset forging machine heading tool assembly (36, 84) comprising:

a header support member (36) presenting a front face (38) and adapted for being movably supported by a support frame (26) for movement between a retracted position spaced from a pair of movable gripper dies (22, 24) and a forging position adjacent to the gripper dies (22, 24) when the gripper dies (22, 24) are in a closed position;

a header (84) having a clamping face (86) and supported on said front face (38) of said header support member (36) for supporting a tool punch (142) for upsetting the forging stock in said forging position;

said header (84) including a channel (90) and a slot opening (88) joining said channel (90) and including a stud (72) extending from a front face (38) of said header support member (36) through said slot opening (88) having a head (78) disposed in said channel (90) for removably securing said header (84) to said header support member (36);

an actuation mechanism (92, 94) for placing said stud (72) in tension to clamp said clamping face (86) of said header (84) against said front face (38) of said header support member (36); and said actuation mechanism (92, 94) including a biasing means (92) for placing said stud (72) in tension and a hydraulic actuator (94) for moving said stud (72) against said biasing means (92) to a release position with said clamping face (86) spaced from said front face (38) to remove said header (84) by sliding said channel (90) along said Dead (78) of said stud (72).

12. An assembly (36, 84) as set forth in claim 11 wherein said biasing means (92) comprises at least one Belleville washer (92).

13. An assembly (36, 84) as set forth in claim 12 wherein said actuator (94) comprises a hydraulic piston and cylinder assembly (94) for moving said stud (72) longitudinally.

14. An assembly (36, 84) as set forth in claim 13 wherein said header support member (36) presents a rear face (40) opposite said front face (38) and sides (42) extending from said front face (38) to said rear face (40).

15. An assembly (36, 84) as set forth in claim 14 including a socket (56) disposed in said rear face (40), said Belleville washer (92) disposed in said socket (56), said hydraulic piston and cylinder assembly (94) disposed in said socket (56).

16. An assembly (36, 84) as set forth in claim 15 including a cavity (54) adjoining said socket (56) and a drive block (58) slidably disposed in said cavity (54) interconnecting said hydraulic piston and cylinder assembly (94) and said stud (72).

17. An assembly (36, 84) as set forth in claim 16 including a pair of said channels (90) and a pair of said slot openings (88).

18. An assembly (36, 84) as set forth in claim 17 including a plurality of said studs (72), a plurality of said sockets (56), a plurality of said cavities (54) and a plurality of grooves (50) in said sides (42) of said header support member (36) extending from said front face (38) to said cavities (54), each of said studs (72) being disposed in one of said grooves (50).

19. An assembly (36, 84) as set forth in claim 18 including a clamp (82) associated with each groove (50) for retaining the associated stud (72) therein.

20. An assembly (36, 84) as set forth in claim 11 including co-acting guides (132, 134, 136, 138) in said clamping face (86) of said header (84) and in said front face (38) of said header support member (36) for aligning said header (84) relative to said header support member (36).

21. An upset forging machine heading tool assembly (36, 84) comprising:

a header support member (36) presenting a front face (38) and adapted for being movably supported by a support frame (26) for movement between a retracted position spaced from a pair of movable gripper dies (22, 24) and a forging position adjacent to the gripper dies (22, 24) when the gripper dies (22, 24) are in a closed position;

a header (84) having a clamping face (86) and supported on said front face (38) of said header support member (36) for supporting a tool punch (142) for upsetting the forging stock in said forging position;

said header (84) including a channel (90) and a slot opening (88) joining said channel (90) and including a stud (72) extending from a front face (38) of said header support member (36) through said slot opening (88) having a head (78) disposed in said channel (90) for removably securing said header (84) to said header support member (36); and co-acting guides (132, 134, 136, 138) in said clamping face (86) of said header (84) and in said front face (38) of said header support member (36) for aligning said header (84) relative to said header support member (36).

22. An assembly (36, 84) as set forth in claim 21 wherein said co-acting guides (132, 134, 136, 138) include a first locator key (132) mounted adjacent to a bottom of said header (84) and a second locator key (134) mounted adjacent to a top of said header (84) with both of said first and second locator keys (132, 134) extending outwardly from said clamping face (86).

23. An assembly (36, 84) as set forth in claim 22 wherein said co-acting guides (132, 134, 136, 138) further include keyways (136, 138) disposed within said header support member (36) such that said first and second locator keys (132, 134) engage said keyways (136, 138) when said header (84) is aligned and mounted to said header support member (36).

24. An assembly (36, 84) as set forth in claim 23 including an actuation mechanism (92, 94) for placing said stud (72) in tension to clamp said clamping face (86) of said header (84) against said front face (38) of said header support member (36), said actuation mechanism (92, 94) including a biasing means (92) for placing said stud (72) in tension and a hydraulic actuator (94) for moving said stud (72) against said biasing means (92) to a release position with said clamping face (86) spaced from said front face (38) to remove said header (84) by sliding said channel (90) along said head (78) of said stud (72).

* * * * *